US007419922B2

(12) United States Patent
Gibson et al.

(10) Patent No.: US 7,419,922 B2
(45) Date of Patent: Sep. 2, 2008

(54) FLAME-RESISTANT, HIGH VISIBILITY, ANTI-STATIC FABRIC AND APPAREL FORMED THEREFROM

(76) Inventors: Richard M. Gibson, 89 Hillcrest Dr., Weaverville, NC (US) 28787; Willis D. Campbell, Jr., 3215 Stillwell Rd., Summerfield, NC (US) 27358; Albert E. Johnson, 206 Shelburne Ct., Burlington, NC (US) 27215; Kenneth P. Wallace, 611 Atwater St., Burlington, NC (US) 27217; William F. Gerrow, 4104 Williams Dairy Rd., Greensboro, NC (US) 27406

( * ) Notice: Subject to any disclaimer, the term of this patent is extended or adjusted under 35 U.S.C. 154(b) by 0 days.

(21) Appl. No.: 11/230,033

(22) Filed: Sep. 19, 2005

(65) Prior Publication Data

US 2006/0068664 A1 Mar. 30, 2006

Related U.S. Application Data

(63) Continuation-in-part of application No. 10/607,092, filed on Jun. 26, 2003, now Pat. No. 6,946,412, which is a continuation-in-part of application No. 09/851, 888, filed on May 9, 2001, now Pat. No. 6,706,650.

(51) Int. Cl.
*D03D 15/00* (2006.01)

(52) U.S. Cl. ..... 442/217; 442/228

(58) Field of Classification Search ..... 442/181, 442/217, 197, 228

See application file for complete search history.

(56) References Cited

U.S. PATENT DOCUMENTS

| | | | |
|---|---|---|---|
| 3,670,068 | A | 6/1972 | Jones et al. |
| 3,729,920 | A | 5/1973 | Sayers et al. |
| 3,806,959 | A | 4/1974 | Gross |
| 3,925,016 | A | 12/1975 | Haase |
| 4,001,477 | A | 1/1977 | Economy et al. |
| 4,035,542 | A | 7/1977 | Rosenthal et al. |
| 4,084,027 | A | 4/1978 | Berni et al. |
| 4,151,322 | A | 4/1979 | Rosenthal et al. |
| 4,167,603 | A | 9/1979 | Sistrunk |
| 4,266,940 | A | 5/1981 | Blackburn et al. |
| 4,336,028 | A | 6/1982 | Tomibe et al. |
| 4,348,306 | A | 9/1982 | Mischutin |
| 4,433,493 | A | 2/1984 | Poisson |
| 4,732,804 | A | 3/1988 | Kujas |
| 4,970,105 | A | 11/1990 | Smith, Jr. |
| 5,033,262 | A | 7/1991 | Montgomery et al. |
| 5,114,786 | A | 5/1992 | Louis |
| 5,180,793 | A | 1/1993 | Vigneault et al. |
| 5,323,815 | A | 6/1994 | Barbeau et al. |
| 5,348,796 | A | 9/1994 | Ichibori et al. |
| 5,397,509 | A | 3/1995 | Kostrzecha |
| 5,448,779 | A | 9/1995 | Aldridge |
| 5,478,154 | A | 12/1995 | Pappas et al. |
| 5,486,412 | A | 1/1996 | Weinrotter et al. |
| 5,496,623 | A | 3/1996 | Fox |
| 5,503,915 | A | 4/1996 | Ichibori et al. |
| 5,503,916 | A | 4/1996 | Ichibori et al. |
| 5,506,042 | A | 4/1996 | Ichibori et al. |
| 5,688,429 | A | 11/1997 | Zakikhani et al. |
| 5,728,448 | A | 3/1998 | Okeya et al. |
| 5,855,623 | A | 1/1999 | English et al. |
| 5,948,148 | A | 9/1999 | Cuevas B. |
| 6,102,128 | A | 8/2000 | Bridgeman |
| 6,287,686 | B1 | 9/2001 | Huang et al. |
| 6,358,608 | B1 | 3/2002 | Hanyon et al. |
| 6,626,964 | B1 | 9/2003 | Lunsford et al. |
| 6,706,650 | B2 | 3/2004 | Gibson et al. |
| 6,787,228 | B2 | 9/2004 | Campbell et al. |
| 6,800,367 | B2 | 10/2004 | Hanyon et al. |
| 6,946,412 | B2 | 9/2005 | Campbell et al. |
| 2005/0208855 | A1 * | 9/2005 | Zhu ..... 442/302 |

OTHER PUBLICATIONS

Pages of brochure for Westex Inc.; believed to be prior art; date unknown.

Web site printout for Head Lites Corporation; beleived to be prior art; date unknown.

Bekintex Innovative Textiles article entitled Bekitex® Highly Electrically Conductive Spun Yarn; believed to be prior art; date unknown.

* cited by examiner

*Primary Examiner*—Nora L. Torres-Velazquez
(74) *Attorney, Agent, or Firm*—Womble Carlyle Sandridge & Rice PLLC; C. Robert Rhodes

(57) ABSTRACT

A fabric is provided for use in safety apparel, including a first yarn type comprising at least about 60 percent modacylic fibers and a second yarn type comprising an intimate blend of anti-static fibers and other fibers selected from the group of fibers consisting of polyester, nylon, rayon, modacrylic, cotton, wool, and combinations thereof. The fabric meets the American Society for Testing and Materials standard ASTM F-1506 for flame resistance, Federal Test Method Standard 191A, Method 5931 for electrostatic decay, and the Electrostatic Discharge Association Advisory ADV11.2-1995 voltage potential.

17 Claims, No Drawings

FLAME-RESISTANT, HIGH VISIBILITY, ANTI-STATIC FABRIC AND APPAREL FORMED THEREFROM

RELATED APPLICATIONS

This is a continuation-in-part of application Ser. No. 10/607,092, filed Jun. 26, 2003, now U.S. Pat. No. 6,946,412 which is a continuation-in-part of Ser. No. 09/851,888 filed May 9, 2001, now U.S. Pat. No. 6,706,650, the contents of which are hereby incorporated in their entireties.

FIELD OF THE INVENTION

The present invention relates generally to fabric and safety apparel formed therefrom, and more particularly to fabric and apparel that, in addition to meeting nationally-recognized standards for flame-resistance and high-visibility, is anti-static.

BACKGROUND OF THE INVENTION

Authorities worldwide have recognized the need to protect occupational workers from the inherent hazards of apparel that is deficient in contrast and visibility when worn by workers exposed to the hazards of low visibility. These hazards are further intensified by the often complex backgrounds found in many occupations such as traffic control, construction, equipment operation, and roadway maintenance. Of major concern is ensuring that these workers are recognized by motor vehicle drivers in sufficient time for the drivers to slow-down or take other preventive action to avoid hazard or injury to the workers. Thus, worker safety is jeopardized when clothing not designed to provide visual identification is worn by persons working in such dangerous environments. While there are no federal regulations governing the design, performance, or use of high-visibility apparel, local jurisdictions and private entities have undertaken to equip their employees with highly luminescent vests. One national standards organization, known as the American National Standards Institute (ANSI), in conjunction with the Safety Equipment Association (ISEA), has developed a standard and guidelines for high-visibility luminescent safety apparel based on classes of apparel.

Similarly, and in related fashion, certain of the above-mentioned occupations also require safety apparel that is flame resistant. For example, electric utility workers who may be exposed to flammable situations require apparel that is flame resistant. In the United States, there is a nationally-recognized standard providing a performance specification for flame resistant textile materials for safety apparel, referred to as the American Society for Testing and Materials (ASTM), standard F 1506. This standard provides performance properties for textile materials used in apparel that represent minimum requirements for worker protection. One component of this standard is the vertical flame test which measures whether an apparel will melt or drip when subjected to a flame, or continue to burn after the flame is removed.

In recent years, utilities have become more diverse. Notably, electric utilities, for example, have diversified into the delivery of natural gas services. Thus, the same utility employees who provide electricity delivery services also service the natural gas network and facilities. This means that these employees not only require high visibility, and flame-resistant apparel, but also require apparel that has anti-static properties suitable for wear in ignitable atmospheres. The anti-static properties of the fabric and apparel enable the dissipation of any static that may develop on one or more areas of the fabric or apparel.

SUMMARY OF THE INVENTION

The present invention is directed to a fabric, and apparel formed therefrom, that meets the minimum guidelines laid out in ANSI/ISEA-107-1999, "American National Standard for High-Visibility Safety Apparel", the vertical flame test of ASTM F 1506 (2000), "Standard Performance Specification for Flame Resistant Textile Materials for Wearing Apparel for Use by Electrical Workers Exposed to Momentary Electric Arc and Related Thermal Hazards", Federal Test Method Standard 191A, Method 5931 (1990), "Determination of Electrostatic Decay of Fabrics", and the Electrostatic Discharge Association advisory ESD ADV11.2-1995, "Triboelectric Charge Accumulation Testing".

ANSI/ISEA-107-1999 specifies requirements for apparel capable of signaling the wearer's presence visually and intended to provide conspicuity of the wearer in hazardous situations under any light conditions by day, and under illumination by vehicle headlights in darkness. As used herein, and as defined in ANSI/ISEA-107, "conspicuity" refers to the characteristics of an object which determine the likelihood that it will come to the attention of an observer, especially in a complex environment which has competing foreground and background objects. Conspicuity is enhanced by high contrast between the clothing and the background against which it is seen. The ANSI standard specifies performance requirements for color, luminance, and reflective area. Three different colors for background and combined performance are defined in the standard. The color selected should provide the maximum contrast with the anticipated background for use of the apparel. Several combinations are described in the standard depending upon the intended use. For example, the ANSI standard describes three classes of conspicuity. For utility workers, the apparel would meet either Class 2 or Class 3 (Appendix B of ANSI 107-1999).

ASTM F 1506 provides a performance specification that may be used to evaluate the properties of fabrics or materials in response to heat and flame under controlled laboratory conditions. For exposure to an open flame, a fabric or apparel must not melt, drip, or continue to burn after the flame is removed. The properties of material for basic protection level wearing apparel should conform to the minimum requirements for woven or knitted fabrics with respect to breaking load, tear resistance, seam slippage, colorfastness, flammability before and after laundering, and arc testing. ASTM F 1506 specifies these performance characteristics based on fabric weight ranges, expressed in ounces per square yard. ASTM F 1506 establishes that an afterflame may not persist for more than 5 seconds when subjected to the arc testing of ASTMF 1959.

With respect to determining the anti-static properties of a fabric, there are several generally recognized test methods known in the art. While there is no one specific test for measuring electrostatic charge accumulation, two known methods provide some assurance that a fabric is electrostatically safe. Federal Test Method Standard 191A, Method 5931, Determination of Electrostatic Decay of Fabrics, which is incorporated herein in its entirety, provides a method for determining the time required for a charge on a fabric surface to decay to an electrostatically safe level. This test method is appropriate for use on material which may or may not contain conductive fibers which have been treated with an anti-static finish. The primary purpose of the test is to determine whether a fabric is safe for wear during electrostatic sensitive operations. Specifically, the test method measures the amount of time, in seconds, for the static imparted to a fabric to decay from 5,000 Volts to 500 Volts.

The Electrostatic Discharge Association Advisory For Protection of Electrostatic Discharge Susceptible Items-Triboelectric Charge Accumulation Testing, ESD ADV11.2-

1995 provides a summary of tribocharging theory and test methods. The test methods contained in the Advisory have been designed to predict which materials will charge to what level and polarity when contacted with a given material. A vest was worn by a technician over a cotton shirt in a humidity controlled room. The field potential of the vest while being worn, as it was removed, and after it was removed was measured by a mill type electrostatic field meter. The potential of the hand of the technician was measured by a charge plate monitor while the vest was being worn and while it was being held after it was removed. In accordance with National Fire Protection Association Standard NFPA 77-2000, Recommended Practice on Static Electricity, potentials of greater than 1,500 volts are considered hazardous in ignitable areas.

The rigorous performance specifications of each of the above test methods are met by the fabric and safety apparel formed from the unique yarns of the present invention. As used herein, the term "fiber" includes staples and filaments.

The present invention is directed to a fabric, and apparel formed therefrom, that meets the aforedescribed nationally-recognized standards for fire resistance, high visibility, and electrostatic decay. It has now been found that fabric formed from yarns comprising modacrylic fibers and anti-static fibers, such as stainless steel, will meet these standards. More particularly, one yarn type comprises a blend of flame resistant modacrylic fibers and other fibers, and a second yarn type comprises a blend of anti-static fibers and other fibers.

Previously, it was believed that yarns formed of more conventional materials such as cotton, polyester, nylon, etc. could not be incorporated into fabrics for the purposes described herein, and still meet the industry standards described above. The inventors have now found, however, that moderate amounts of these conventional materials can be incorporated into the fabrics for comfort, economy, etc.

In one exemplary embodiment, fabric constructed according to the present invention is formed from two types of yarns. One yarn type, also referred herein as "body yarn", since it forms substantially the main body of the fabric, is formed from modacrylic fibers or a blend of modacrylic fibers and selected other fibers that are spun in accordance with conventionally known techniques. It has been found that fabrics formed from such blended yarns, wherein the modacrylic fibers used to form the yarns provide a flame-resistance rating, meet at least the vertical flame burn test minimum criteria for safety apparel. Blending conventional fibers with the modacrylic fibers permits other desired characteristics and properties to be incorporated into the fabric and apparel.

The second yarn type, also referred herein as the "anti-static yarn", is a blend of conductive anti-static fibers with modacrylic fibers and/or other conventional fibers. It has been found that metallic fibers such as stainless steel fibers blended with conventional fibers provide suitable electrostatic discharge and low voltage potentials. In one preferred embodiment, the second yarn comprises about 20 percent stainless steel fibers and about 80 percent polyester fibers.

The fabric may be either woven or knit to achieve a warp and weft construction. The inherently flame resistant material is dyed in conventional fashion in a jet dye machine with cationic, or basic, dyestuff compositions to obtain International Yellow or International Orange hues that will meet the luminescence and chromacity requirements of ANSI/ISEA-107-1999.

One aspect of the present invention is directed to fabric formed from a blend of staple fibers that comprise at least about 60% flame resistant modacrylic staples. The remaining, other, staple fibers are selected from more conventional synthetic polymer or natural fiber material. Specifically, it has been found that polyester, nylon, rayon, cotton, and wool are particularly suited for blending with the modacrylic fibers. As is well known in the art, staples are defined as fibers having a length of less than about 2.5 inches. A blend is also well known in the art as the combination of two or more staple fibers, wherein when combined, the different staple fibers are uniformly distributed. The second yarn is a conventional yarn, or even modacrylic yarn, that has some conductive anti-static fibers blended therein.

Modacrylic fibers, by definition, are composed of less than 85 percent, but at least 35 percent by weight of acrylonitrile units. Modacrylic fibers have two characteristics that address the problems confronted by the inventors of the present invention. First, modacrylic fibers are inherently flame resistant, with the level of flame resistance varying based upon the weight percentage of acrylonitriles in the composition. Secondly, modacrylic fibers are very receptive to cationic dyes, which are known for their brilliance.

Polyester fibers are relatively strong and are resistant to shrinking and stretching. Other non-flame resistant, conventional, fibers include nylon, rayon, cotton, wool, and combinations thereof. Nylon fibers also are relatively strong, tough, and abrasion resistant. Rayon is composed of regenerated cellulose and can be formed into relatively strong fibers having a good hand and good aesthetic characteristics. Cotton is also strong and has excellent absorbency. Wool, on the other hand, blends well with both synthetic and other natural fibers to form a blend having good tensile strength. While polyester, nylon, rayon, cotton, and wool are economical constituents of the blend that have been found particularly suitable for blending with modacrylic staples, other synthetic polymers may also be suitably blended with the modacrylic staples. The choice of one or more staple fibers to blend with the flame resistant staples depends upon other non-flame resistant properties desired in the finished fabric and apparel, including hairiness and hand, strength, flexibility, absorbency, etc.

While the exemplary embodiment described herein is formed from yarns comprising an intimate blend of modacrylic and conventional fibers, and a blend of conventional fibers and stainless steel fibers, the yarn and fabric constructions are not limited thereto. For example, the stainless steel fibers could also be blended with modacrylic fibers.

A further aspect of the present invention is directed to high-visibility, flame-resistant, and anti-static fabric and apparel wherein the anti-static component is incorporated into yarns that are placed in both the warp and weft directions. As used herein, the terms "warp" and "weft" apply to conventional woven, and certain knitted, constructions. More particularly, at least one anti-static yarn is incorporated at least about every two centimeters in both the warp and weft directions. When so incorporated in this manner, the anti-static yarns form a grid of overlapping anti-static yarns. It has been found that having (1) yarns oriented in two directions, and (2) yarns overlapping and in contact with one another in a grid, provides optimal static dissipation; however, where an overlapping anti-static structure or grid is not required, other fabric constructions such as circular knit constructions may be utilized.

These and other aspects of the present invention will become apparent to those skilled in the art after a reading of the following description of the preferred embodiment.

DESCRIPTION OF THE PREFERRED EMBODIMENT

Having described the industry standards that provide the acceptance criteria for basic protection levels for occupational workers, the fabric, and apparel formed therefrom, of the present invention is formed from two types of yarn that each comprise a blend of materials that will meet each of the standards.

In a preferred embodiment, the fabric construction comprises two types of yarns. One yarn type (the body yarn) is formed from a blend comprising at least about 60 percent modacrylic fibers, combined with up to about 40 percent of other synthetic or natural fibers, including conventional fibers wherein the yarn is flame resistance and has a high affinity for high-visibility dyestuffs. Examples of synthetic fibers that have been found particularly suitable include polyester, rayon, and nylon. Alternatively, the modacrylic staples may be blended with up to about 40 percent natural fibers, such as cotton and wool.

The second yarn type (the anti-static yarn) is a blend of anti-static fibers and other fibers. In one preferred embodiment, the anti-static fibers comprise stainless steel fibers; however, other metallic and non-metallic anti-static conductive fibers, such as carbon fibers, may also be used.

Modacrylics are polymers that have between 35 percent and 85 percent acrylonitrile units, modified by other chemical modifiers such as vinyl chloride. All modacrylics have a flame-resistant character to some extent, however, it has been found that fabrics formed from modacrylic yarns having at least about 50 percent by weight of acrylonitrile units will provide excellent flame resistance. That is, they will not melt and drip, or continue to burn when a source of ignition is removed. Although other modacrylic fibers could be used to form the yarn and fabric of the present invention, the yarn and fabric of the present invention is formed from short staple fibers of Kanecaron® SYS. Kanecaron® SYS is a 1.7 denier, 2 inch modacrylic staple fiber manufactured by Kaneka Corporation, Osaka, Japan. Kanecaron® SYS fiber has a tenacity of about 3 grams/denier, a Young's Modulus of about 270 kg/mm$^2$, a dull luster, and has been found to meet the structural requirements of both ANSI/ISEA-107-1999 and ASTM F 1506. Modacrylic fibers having tenacities of at least about 2 grams/denier are also suitable to form the yarn and fabric of the present invention.

Polyester fibers have high strength and are resistant to shrinking and stretching. Nylon fibers also have high strength, toughness, and abrasion resistance. Rayon is composed of regenerated cellulose and can be formed into high strength fibers having a good hand and good aesthetic characteristics. Cotton is also strong and has excellent absorbency. Wool, on the other hand, blends well with both synthetic and other natural fibers to form a blend having good tensile strength. While polyester, nylon, rayon, cotton, and wool are economical constituents of the blend that have been found particularly suitable for blending with modacrylic staples, other synthetic polymers may also be suitably blended with the modacrylic staples. The choice of one or more staple fibers to blend with the modacrylic staples depends upon other non-flame resistant properties desired in the finished fabric and apparel, including hairiness and hand, strength, flexibility, absorbency, etc.

In the second, or anti-static yarn, the anti-static fibers are blended with conventional staple fibers. While anti-static fibers are not limited to metallic fibers, in one embodiment the anti-static fibers are stainless steel. Such a blended yarn construction is available from Bekaert Fiber Technologies of Marietta, Ga. under the trademark BEKITEX®. This yarn construction comprises about 80% PES (polyester) staple fibers and 20% stainless steel staple fibers; however, the yarn construction is not limited to a particular yarn size or to particular quantities of either anti-static or conventional fiber sizes.

With respect to static decay, a safety garment (vest) woven from yarns comprising the first and second yarn types described herein were tested in accordance with Federal Test Method Standard 191A, Method 5931 (1990), incorporated herein in its entirety. In accordance with this method, six specimens are tested, three in the fabric warp direction and three in the fabric fill direction. Each specimen is about 3 by 5 inchdes and the direction of testing (warp or fill) is along the length of the specimen. As a precondition, the specimens are maintained in an environment having a relative humidity of between 8 and 12 percent and then conditioned at between 18 and 22 percent relative humidity for a minimum of 24 hours. The specimens are tested at between 18 and 22 percent relative humidity and between 70 and 80 degrees Fahrenheit. A voltage source applies 5,000 volts to the specimen. A measure is then made of the time in seconds required for the 5,000 volts to decay to 500 volts. The specimen is acceptable if the decay time to 500 volts (10 percent of the starting voltage) is less than 0.5 seconds, and considered unacceptable otherwise. The results of the testing are shown in the following Table I.

TABLE I

| | Maximum | Minimum | Average | Std. Dev. |
|---|---|---|---|---|
| +5kV | 0.01 | 0.01 | 0.01 | 0.0 |
| −5kV | 0.01 | 0.01 | 0.01 | 0.0 |

The average time to decay to 500 volts for each of the warp and fill directions is 0.01 seconds, which is the lower limit of the test method. As shown in the Table, the overall average for the fabric was also 0.01 seconds.

Testing was also undertaken in accordance with ESD ADV11.2-1995, Triboelectric Charge Accumulation Testing. In accordance with this test method, a garment (vest) was tested at 12 percent relative humidity and 72 degrees Fahrenheit. A vest was worn by a technician over a cotton shirt in a humidity controlled room. The field potential of the vest while being worn, as it was removed, and after it was removed was measured by a mill type electrostatic field meter. The potential of the hand of the technician was measured by a charge plate monitor while the vest was being worn and while it was being held after it was removed. In accordance with National Fire Protection Association Standard NFPA 77-2000, Recommended Practice on Static Electricity, potentials of greater than 1,500 volts are considered hazardous in ignitable areas. As shown in Table II, the highest potential measured was only 570 volts/meter. Although ESD ADV11.2 warns that test results are not necessarily repeatable, the inventors have concluded through independent testing that the measured potential voltage is sufficiently low that the vest is considered suitable for use in areas where ignitable atmospheres are present.

TABLE II

| Electrostatic Field | Maximum Voltage Measured |
|---|---|
| Vest as Worn | 570 Volts/meter |
| Vest Being Removed | 380 Volts/meter |
| Vest After Removal | 150 Volts/meter |
| Potential on Person Wearing Vest | 250 Volts |
| Potential on Person Holding Removed Vest | 280 Volts |

The process for making fabric according to the present invention, using the materials described above, is discussed in detail below.

The Process

As described above, the anti-static yarn, i.e., the second yarn type is available from Bakaert Fiber Technologies. With respect to the first yarn type construction, as is conventional in short staple yarn manufacture, bales of short staple fibers, in the percentages described above, are initially subjected to an opening process whereby the compacted fibers are "pulled"

or "plucked" in preparation for carding. Opening serves to promote cleaning, and intimate blending of fibers in a uniform mixture, during the yarn formation process. Those skilled in the art will appreciate that there are a number of conventional hoppers and fine openers that are acceptable for this process. The open and blended fibers are next carded using Marzoli CX300 Cards to form card slivers. The card slivers are transformed into drawing slivers through a drawing process utilizing a process known as breaker drawing on a Rieter SB951 Drawframe and finisher drawing on a Rieter RSB951 Drawframe. Drawn slivers are next subjected to a Roving process conventionally known in preparation for Ring Spinning. A Saco-Lowell Rovematic Roving Frame with Suessen Drafting is used to twist, lay and wind the sliver into roving. A Marzoli NSF2/L Spinning Frame is used to ring spun the yarn product. Winding, doubling, and twisting processes conventionally known in the art are used in completing the yarn product.

The illustrated fabric is woven; however, other constructions, such as knitted, and non-woven constructions may be used, provided they meet the design and structural requirements of the two standards, and can be formed with an overlapping warp and weft structure.

One exemplary fabric is woven (plain weave) on a Picanol air jet loom with 46 warp ends and 34 fill ends of yarn per inch and an off-loom width of 71 inches. In a preferred embodiment, after every 43 ends (picks) in the fill direction, one pick of anti-static yarn is woven in. In the warp direction, one end of the anti-static yarn is woven in after every 55 ends of the first yarn type. This creates an anti-static grid of about 2 cm squares; however smaller and larger grid sizes will also provide suitable results. While not required, it has been found by the inventors that the anti-static yarns are preferably woven in both the warp and fill directions to obtain these grids to promote static decay and acceptable potential voltages. Further, to satisfy the standards described herein, the inventors have found that the anti-static (stainless steel fiber) component should be between about 0.5 percent and 5 percent of the total fabric, with a desired amount of about 1 percent.

Any looms capable of weaving modacrylic yarns may just as suitably be used. The woven fabric has a desired weight of approximately 4 to 20 ounces per square yard, and desirably about 7.5 ounces per square yard as necessary to satisfy the design requirements for the particular class of safety apparel.

In preparation for dyeing, the woven fabric is subjected to desizing and scouring to remove impurities and sizes such as polyacrylic acid. The process of desizing is well known in the art. A non-ionic agent is applied in a bath at between about 0.2 and 0.5 weight percent of the fabric and an oxidation desizing agent is applied in a bath at about 2 to 3 percent of fabric weight. The use of such agents is well known in the art. The processing, or run, time for desizing and scouring is approximately 15 to 20 minutes at 60° C. The fabric is then rinsed with water at a temperature of 60° C.

The pretreated fabric is then ready for dyeing and finishing. It is well known to those in the art that the dyeing of fabric formed from blended yarns will normally require multiple dyestuffs. Because of the combination of different dyes and their individual temperature and processing requirements, dyeing is typically a two-step process. The dyeing is formed in a jet dye machine such as a Model Mark IV manufactured by Gaston County Machine Company of Stanley, N.C. The specific dyes used to color the modacrylic component of the present invention are basic, or cationic, dyestuffs. The cationic dyes are known for their acceptability in dyeing polyesters, nylons, acrylics, and modacrylics. Until recently, it was not known that these dyes could be formulated to dye modacrylic material in order to meet the luminance and chromacity criteria for safety apparel according to ANSI/ISEA-107 and the fire resistant criteria of ASTM F 1506. Two dye formulations have been found to meet the high visibility criteria for ANSI/ISEA-107. A dye formulation for International Yellow comprises basic Flavine Yellow, available from Dundee Color of Shelby, N.C. as color number 10GFF. It has been found that this dyestuff applied at between about 2 to 2½ percent of fabric weight successfully achieves the ANSI criteria. A dye formulation for International Orange may be formed from Blue and Red cationic dyestuffs, available from Yorkshire America in Rock Hill, S.C., as color numbers Sevron Blue 5GMF and Sevron Brilliant Red 4G and applied at percentages sufficient to meet the ANSI/ISEA-107 shade requirements.

For dyeing the modacrylic component of the fabric, a dyestuff, as described above is added to the jet dye machine. The Ph of the bath is established at between about 3 and 4, with acid used to adjust the Ph as required. The bath temperature in the jet dyer is raised at about 1° C. per minute to a temperature of about 80° C., where the temperature is held for approximately 10 minutes. The temperature is then raised approximately 0.5° C. per minute to a temperature of 98° C. and held for approximately 60 minutes. The bath is then cooled at about 2° C. per minute to 60° C. At that point, the bath is emptied and rinsing with water at 60° C. occurs until the dye stuff residue in the jet dyer is removed.

For the second stage of the dyeing processs, a dyestuff is selected that is suitable for the other selected component of the yarn, and hence the fabric. Where the second component is polyester, the preferred dye is a disperse dye having a color formulation that is comparable to the formulation used to dye the flame resistant component. As those skilled in the art will appreciate, the procedure and controls for applying the various types of dyes are well known and vary with the material being dyed. Where the second component is nylon, the preferred dye is an acid dye, again having a color formulation that is comparable to the formulation used to dye the flame resistant component. Where the second component is rayon, the preferred dyestuffs include direct dyes, reactive dyes, and vat dyes.

Where the second component is a natural material, such as cotton, the preferred dyestuffs include direct dyes, reactive dyes, and vat dyes. Where wool is the selected second component, the preferred dye is an acid dye.

As those skilled in the art will appreciate, the order of the dyeing steps or stages may be reversed or altered, as well as the number of steps or stages.

At this point, the dyeing cycle is complete. Wet fabric is removed from the dye machine where it is dried on a standard propane open width tenter frame running at approximately 40 yards per minute at approximately 280° F. to stabilize width and shrinkage performance. At the completion of this process, the fabric meets the ANSI standard for high visibility safety apparel and the ASTM standard for flame resistance.

The finished fabric may be used to construct an unlimited number of types of safety apparel. The most common types are shirts or vests, and trousers or coveralls. The final constructed garments are designed and formed to meet the design, structural, and fastening criteria of the ANSI and ASTM standards.

It should be recognized that the preferred embodiment described above is exemplary only. Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric of the type formed of warp and weft yarns for use in safety apparel comprising:

(a) a first body yarn comprising at least 60% modacrylic fibers and no anti-static fibers;

(b) a second anti-static yarn comprising an intimate blend of anti-static fibers and other fibers selected from the group consisting of polyester, nylon, rayon, modacrylic, cotton, wool, and combinations thereof.

(c) the fabric being formed primarily of the first body yarns, and a minor number of the second anti-static yarns occurring at spaced distances in both the warp and the weft directions;

(d) wherein the fabric meets the American Society for Testing and Materials standard ASTM F-1506 for flame resistance, Federal Test Method Standard 191A, Method 5331 for electrostatic decay, and the Electrostatic Discharge Association Advisory ADV11.2-1995 voltage potential; and (e) wherein the fabric includes a high visibility dye that meets the American National Standards Institute standard ANSI/ISEA-107 minimum conspicuity requirements for occupational activities for high visibility safety apparel.

2. The fabric of claim 1 wherein the first yarn type comprises an intimate blend of modacrylic fibers and fibers selected from the group consisting of polyester, nylon, rayon, cotton, and wool.

3. The fabric of claim 1 wherein the anti-static fibers are stainless steel fibers.

4. The fabric of claim 3 wherein the fabric comprises a warp and weft structure having at least about 0.5 percent stainless steel.

5. The fabric of claim 4 wherein the stainless steel comprises between about 0.5 percent and 5 percent of the fabric.

6. The fabric of claim 5 wherein the stainless steel comprises about 1 percent of the fabric.

7. The fabric of claim 1 wherein the yarn type comprising the anti-static fibers occurs at least about every 2 centimeters in the warp and at least about every 2 centimeters in the weft, thereby forming a grid.

8. The fabric of claim 3 wherein the stainless steel fibers comprise about 20 percent of the second yarn type.

9. A safety garment comprising a fabric formed of warp and weft yarns, the fabric comprising:

(a) a first body yarn comprising at least 60% modacrylic fibers and no anti-static fibers;

(b) a second anti-static yarn comprising an intimate blend of anti-static fibers and other fibers selected from the group consisting of polyester, nylon, rayon, modacrylic, cotton, wool, and combinations thereof;

(c) the fabric being formed primarily of the first body yarns, and a minor number of the second anti-static yarns occurring at spaced distances in both the warp and the weft directions;

(d) wherein the fabric meets the American Society for Testing and Materials standard ASTM F-1506 for flame resistance, Federal Test Method Standard 191A, Method 5331 for electrostatic decay, and the Electrostatic Discharge Association Advisory ADV11.2-1995 potential; and (e) wherein the fabric includes a high visibility dye that meets the American National Standards Institute standard ANSI/ISEA-107 minimum conspicuity requirements for occupational activities for high visibility safety apparel.

10. The safety garment of claim 9 wherein the first yarn type comprises an intimate blend of modacrylic fibers and fibers selected from the group consisting of polyester, nylon, rayon, cotton, and wool.

11. The safety garment of claim 9 wherein the anti-static fibers are stainless steel fibers.

12. The fabric of claim 11 wherein the stainless steel fibers comprise about 20 percent of the second yarn type.

13. The safety garment of claim 9 wherein the fabric comprises a warp and weft structure having at least about 0.5 percent stainless steel.

14. The safety garment of claim 13 wherein the stainless steel comprises between about 0.5 percent and 5 percent of the fabric.

15. The safety garment of claim 14 wherein the stainless steel comprises about 1 percent of the fabric.

16. The safety garment of claim 13 wherein the yarn type comprising the anti-static fibers occurs at least about every 2 centimeters in the warp and at least about every 2 centimeters in the weft, thereby forming a grid.

17. A method of constructing a fabric for use in safety apparel comprising the steps of:

(a) forming a fabric of warp and weft yarns having:

(i) a first body yarn having at least 60% modacrylic fibers and no anti-static yarn;

(ii) a second anti-static yarn having an intimate blend of anti-static fibers and other fibers selected from the group consisting of polyester, nylon, rayon, modacrylic, cotton, wool, and combinations thereof;

(b) the fabric being formed primarily of the first body yarns, and a minor number of the second anti-static yarns occurring at distances in both the warp and weft direction;

(e) wherein the fabric wherein the fabric meets the American Society for Testing and Materials standard ASTM F-1506 for flame resistance, Federal Test Method Standard 191A, Method 5331 for electrostatic decay and the Electrostatic Discharge Association Advisory ADV11.2-1995 voltage potential;

(f) dyeing the fabric in multiple steps wherein a first dye type compatible with the modacrylic fibers is applied, then a second dye compatible with the other fibers is applied; and (g) wherein the fabric meets the American National Standards Institute standard ANSI/ISEA-107 minimum conspicuity requirements for occupational activities for high visibility safety apparel.

* * * * *